US011781080B2

(12) United States Patent
McNamara

(10) Patent No.: US 11,781,080 B2
(45) Date of Patent: Oct. 10, 2023

(54) GASIFICATION APPARATUS WITH CONTROLLER FOR NEGATIVE PRESSURE

(71) Applicant: AGS ENERGY (IRELAND) LIMITED, Mahon (IE)

(72) Inventor: Edward McNamara, Cork (IE)

(73) Assignee: AGS ENERGY (IRELAND) LIMITED, Cork (IE)

( * ) Notice: Subject to any disclaimer, the term of this patent is extended or adjusted under 35 U.S.C. 154(b) by 0 days.

(21) Appl. No.: 17/635,865

(22) PCT Filed: Aug. 19, 2020

(86) PCT No.: PCT/EP2020/073166
§ 371 (c)(1),
(2) Date: Feb. 16, 2022

(87) PCT Pub. No.: WO2021/032770
PCT Pub. Date: Feb. 25, 2021

(65) Prior Publication Data

US 2022/0290063 A1 Sep. 15, 2022

(30) Foreign Application Priority Data

Aug. 21, 2019 (EP) ..... 19192811

(51) Int. Cl.
*C10J 3/72* (2006.01)
*C10J 3/00* (2006.01)

(52) U.S. Cl.
CPC ..... *C10J 3/007* (2013.01); *C10J 3/723* (2013.01); *C10J 2200/09* (2013.01);
(Continued)

(58) Field of Classification Search
CPC ..... C10J 2200/09; C10J 2200/158; C10J 2300/0956; C10J 2300/0959;
(Continued)

(56) References Cited

U.S. PATENT DOCUMENTS 4,476,838 A * 10/1984 Fukumoto ..... F02M 31/093 180/189
4,531,462 A * 7/1985 Payne ..... C10J 3/40 110/101 CD (Continued)

FOREIGN PATENT DOCUMENTS

| | | |
|---|---|---|
| EP | 2 063 965 A1 | 6/2009 |
| KR | 101 408 686 B1 | 6/2014 |
| WO | 2017/068163 A2 | 4/2017 |

OTHER PUBLICATIONS

International Search Report issued in PCT/EP2020/073166; dated Nov. 25, 2020.

(Continued)

*Primary Examiner* — Imran Akram

(74) *Attorney, Agent, or Firm* — Studebaker & Brackett PC

(57) ABSTRACT

A gasification apparatus has a primary chamber with a floor comprising a hearth and feedstock augers, for gasification of feedstock. There is a mixing chamber for receiving through an opening synthetic gases from the primary chamber and comprising an air inlet fan for adding oxygen for ignition. There is also a secondary chamber linked with the mixing chamber to deliver heat from combustion of gases from the mixing chamber to the hearth. An outlet valve delivers gases from the secondary chamber through a heat exchanger and to an induce draft fan. A controller dynamically controls flow of gases in the chambers according to sensed pressures and temperatures in said chambers.

13 Claims, 7 Drawing Sheets

(52) U.S. Cl.
CPC .. *C10J 2200/158* (2013.01); *C10J 2300/0956* (2013.01); *C10J 2300/0959* (2013.01); *C10J 2300/1207* (2013.01); *C10J 2300/1215* (2013.01); *C10J 2300/1223* (2013.01); *C10J 2300/1606* (2013.01); *C10J 2300/1838* (2013.01)

(58) Field of Classification Search
CPC ..... C10J 2300/1207; C10J 2300/1215; C10J 2300/1223; C10J 2300/1606; C10J 2300/1838; C10J 3/002; C10J 3/007; C10J 3/723
See application file for complete search history.

(56) References Cited

U.S. PATENT DOCUMENTS 5,279,234 A * 1/1994 Bender ..... F23G 5/027 110/162
2007/0137537 A1* 6/2007 Drisdelle ..... F23N 3/082 110/297
2009/0064578 A1* 3/2009 Theegala ..... C10J 3/34 48/203
2009/0200180 A1* 8/2009 Capote ..... F23G 5/085 205/744
2011/0278150 A1* 11/2011 Mulqueen ..... C10B 57/02 202/99
2012/0256129 A1* 10/2012 Bell ..... C10J 3/723 252/373
2014/0301934 A1* 10/2014 Tucker ..... C10B 47/30 423/445 B
2022/0089961 A1* 3/2022 Ford ..... C10K 1/06

OTHER PUBLICATIONS

GB Search Report dated Jan. 26, 2021, which corresponds to GB2012931.8 and is related to the US application attached herewith.

* cited by examiner

Section A- A

GASIFICATION APPARATUS WITH CONTROLLER FOR NEGATIVE PRESSURE

INTRODUCTION

The invention relates to a gasification apparatus and method for treatment of organic feedstocks such as organic waste, and to a method for such treatment.

EP2063965 (Brookes) describes a gasifier, in which there is a primary chamber for waste gasification, and synthetic gases from this gasification are fed into a secondary chamber to drive the gasification process.

The invention is directed towards improving efficiency of such a gasifier type.

SUMMARY

A gasification apparatus is set out in claims 1 to 28 appended hereto. A gasification method is set out in appended claims 29 to 42.

Also, we describe a gasification apparatus comprising:

- a primary chamber with a floor comprising a hearth and feedstock augers, for gasification of feedstock,
- a mixing chamber for receiving, through an opening, synthetic gases from the primary chamber, and comprising an inlet fan for adding oxygen for ignition, and
- a secondary chamber linked with the mixing chamber to deliver heat from combustion of gases from the mixing chamber to the hearth, said hearth forming a roof of the secondary chamber, and the secondary chamber including baffles for flow under the hearth, and an outlet valve for delivery of gases from the secondary chamber.

Preferably, there is a fan downstream of the secondary chamber and a controller configured to dynamically control flow of gases in the chambers according to sensed pressures and temperatures in said chambers, said controlled flow including flow through the secondary chamber around said baffles to optimise combustion in an after-burner phase and said control including controlling flow rate caused by the downstream fan.

Preferably, the controller is configured to cause said after-burner phase for passage through the secondary chamber to have a duration of at least 3 seconds. Preferably, the fan is an induced draft fan.

Preferably, the apparatus includes a valve at a secondary chamber outlet for directing gases downstream under normal process conditions or to a safety vent through a diverter valve. Preferably, the safety vent comprises a flue with a barometric damper. Preferably, there is a heat exchanger downstream of the secondary chamber, said heat exchanger being linked to a heat recovery system.

The apparatus may further comprise a filter downstream of the heat exchanger, and the filter preferably comprises a reagent dosing apparatus followed by a ceramic filter apparatus.

Preferably, the reagent dosing apparatus is configured to add controlled quantities of treatment substances, for example, urea, calcium carbonate, sodium bicarbonate and activated carbon. Preferably, the substances are suitable to neutralise or remove potentially harmful substances in the exhaust gases.

Preferably, the primary chamber comprises at least one air inlet for inlet of air over the hearth, under control of the pressure created in the mixing chamber by the mixing chamber air inlet pump.

Preferably, the controller is configured to cause air flows through the air inlet valves to maintain both optimal synthetic gas to air ratio and a desired pressure differential between the primary chamber and the mixing chamber for maintaining a negative pressure oxygen deprived environment within the primary chamber. Preferably, the controller is configured to maintain a pressure in the range of −50 Pa to −200 Pa (−5 mm to −20 mm $H_2O$) in said oxygen deprived environment.

Preferably, the controller is configured to control the mixing chamber air inlet pump to maintain temperature in the secondary chamber in the range of 850° C. and 1050° C.

Preferably, the controller is configured such that if the temperature in the secondary chamber begins to increase above a target, the mixing chamber air inlet pump increases the supply of air until the temperature drops back to at or near a target temperature for steady-state operation.

Preferably, the mixing chamber includes a burner for process start-up, and the controller is configured to shut down the burner when an autothermic stage is reached with a target temperature for the primary chamber. Preferably, the burner is located in a lower portion of the mixing chamber.

Preferably, said opening between the primary chamber and the mixing chamber comprises an aperture in a dividing wall between said chambers and said aperture is situated at least 250 mm above a top level of the augers in the primary chamber.

Preferably, the controller is configured to control said secondary chamber outlet valve to assist with control of temperature in the secondary chamber during start-up.

Preferably, the controller is configured to modulate said valve between 0% and 100% opening by the controller (100).

The controller may be configured to cause flow of gases from the secondary chamber at a temperature in the range of 700° C. and 900° C. and to control the heat exchanger (60) to reduce the temperature of the gases to a value in the range of 160° C. to 200° C.

The apparatus may further comprise temperature sensors at an inlet of the heat exchanger and at an outlet of the heat exchanger and the controller is configured to modulate the downstream fan and the mixing chamber air inlet fan to maintain exhaust gas temperatures from the secondary chamber within a desired range.

Preferably, the controller is configured to actuate a diverter damper valve to divert exhaust gases to atmosphere if temperature at the heat exchanger inlet exceeds a threshold.

Preferably, the controller is configured to maintain the temperature of the primary chamber in the range of 500° C. to 1000° C., and of the secondary chamber in the range of 550° C. to 1200° C.

Preferably, the controller is configured to maintain the temperature of the heat exchanger inlet in the range of 600° C. to 850° C. and of the heat exchanger outlet in the range of 160° C. and 220° C.

We also describe gasification methods as set out in the accompanying claims 26 to 36.

DETAILED DESCRIPTION OF THE INVENTION

The invention will be more clearly understood from the following description of some embodiments thereof, given by way of example only with reference to the accompanying drawings in which.

Figure 4:
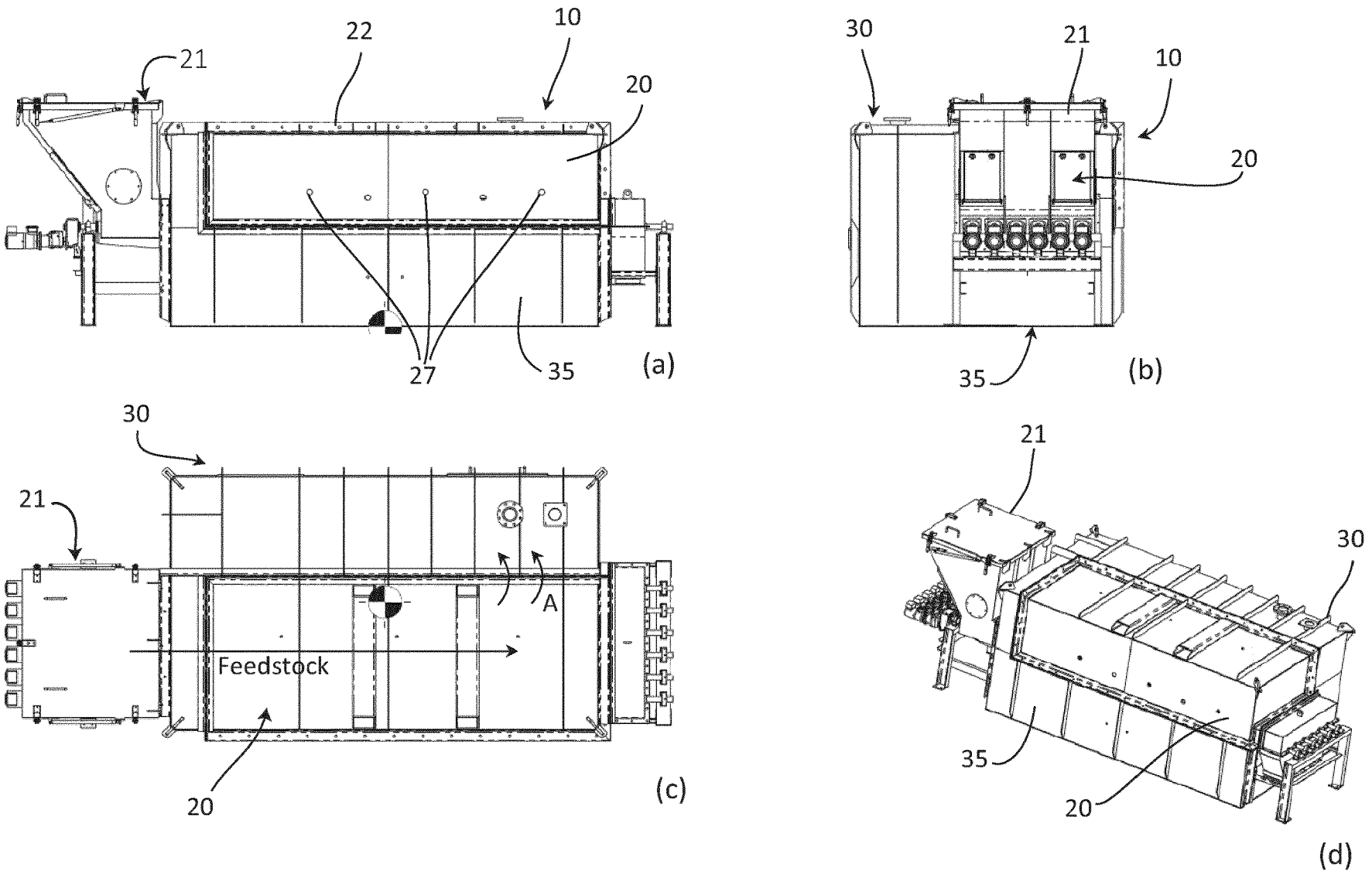
Figure 5:
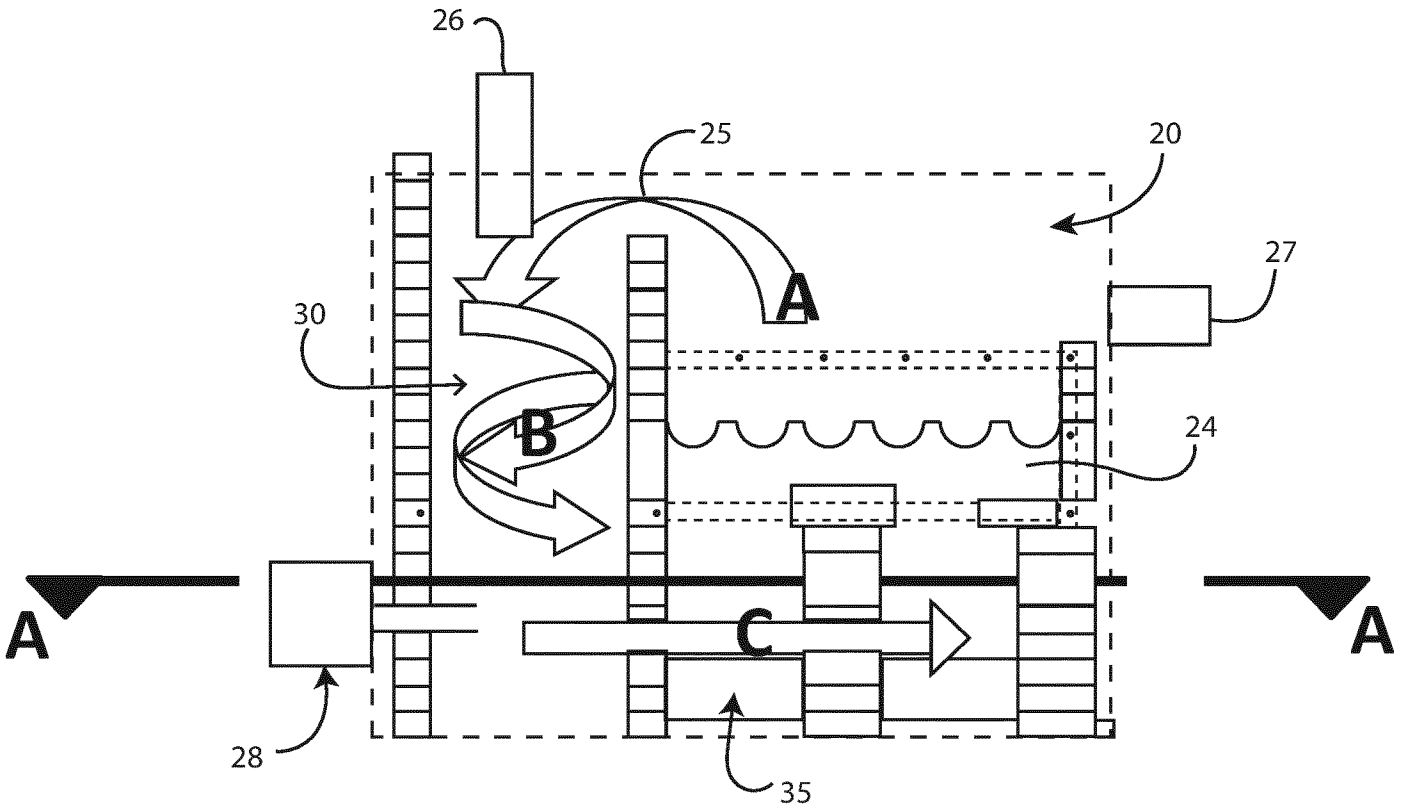
Figure 6:
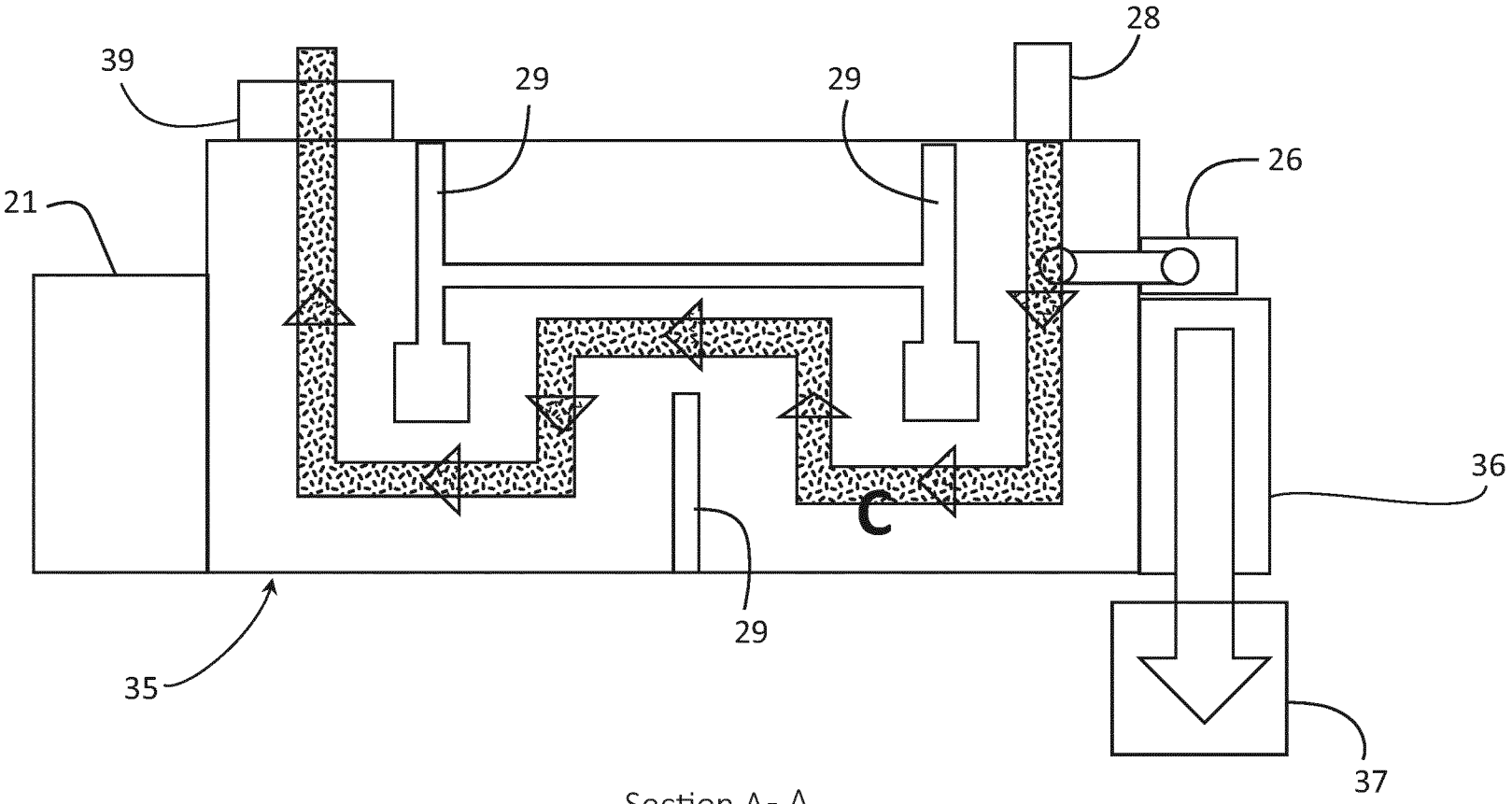
Figure 7:
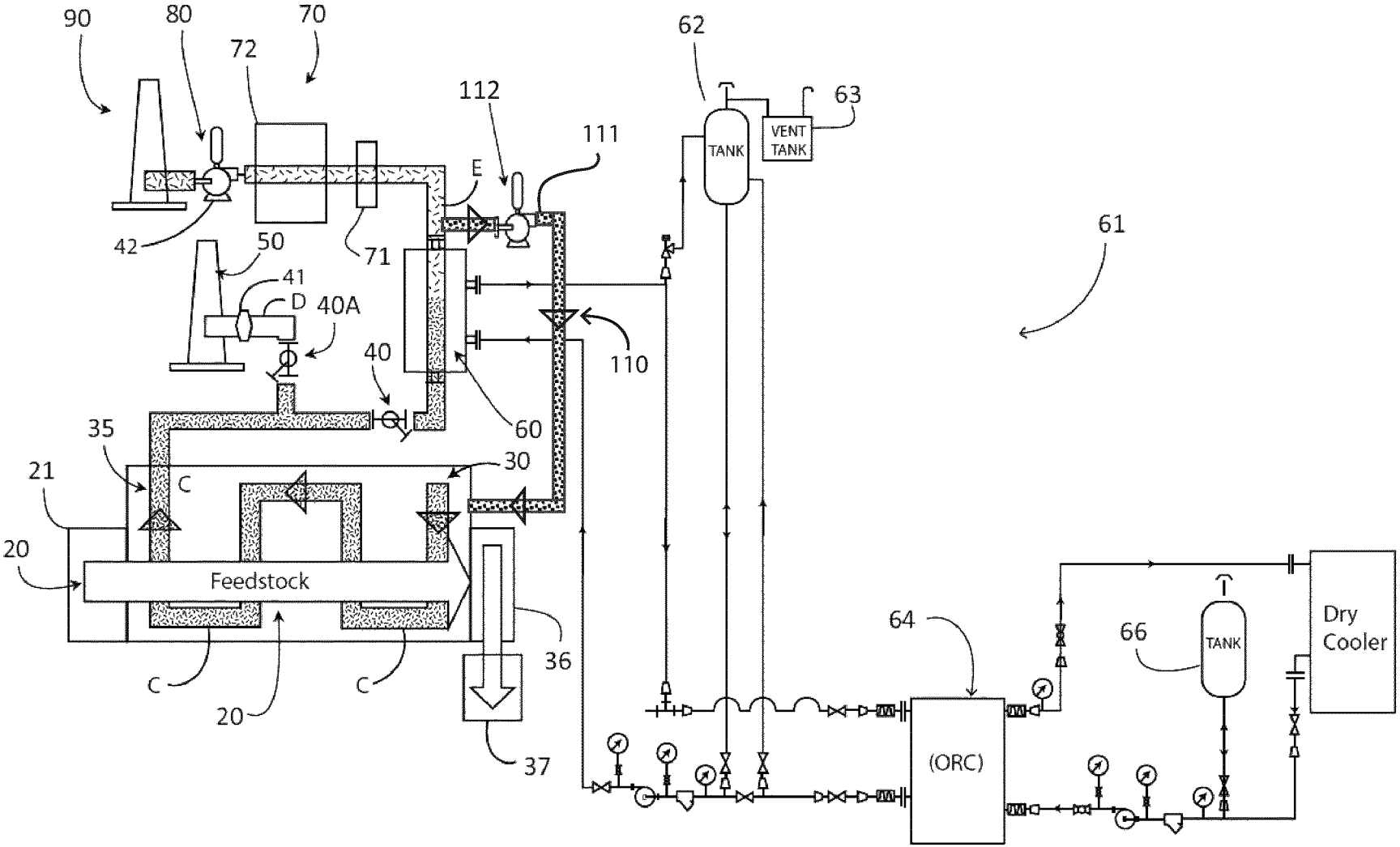

FIGS. 4(*a*), (*b*), (*c*) and (*d*) are side, end, plan and perspective views respectively of an upstream unit of the system including primary, mixing and secondary gasifier chambers;

FIG. 5 illustrates patterns of gaseous flows in the gasifier in an elevational view, FIG. 6 is a cross-sectional plan view in the direction of the arrows A-A in FIG. 5, also showing flows in the gasifier; and FIG. 7 is a flow diagram illustrating a modified system.

Figure 1:
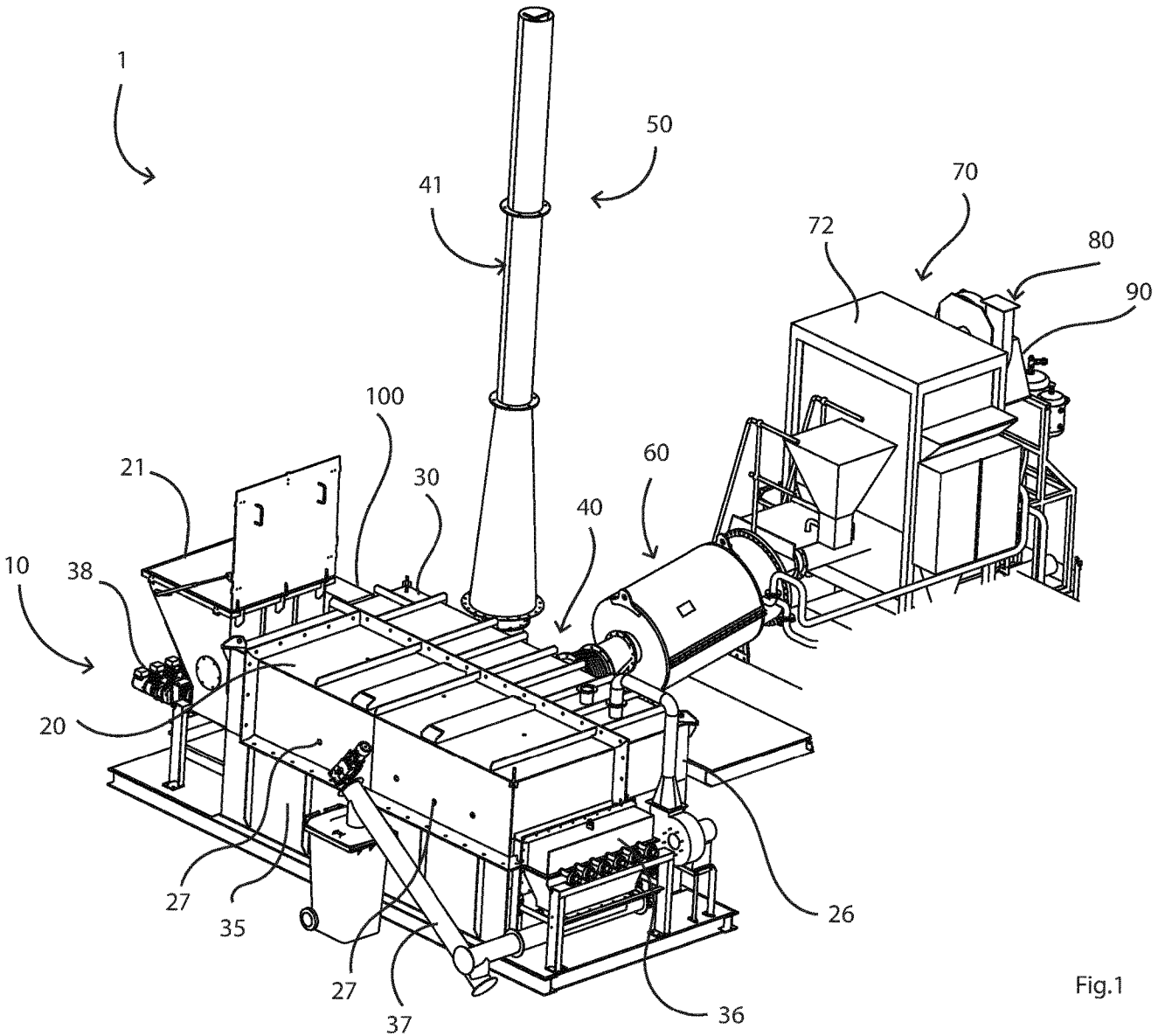
FIGS. 1 and 2 are perspective views of a gasifier system of the invention.
Figure 2:
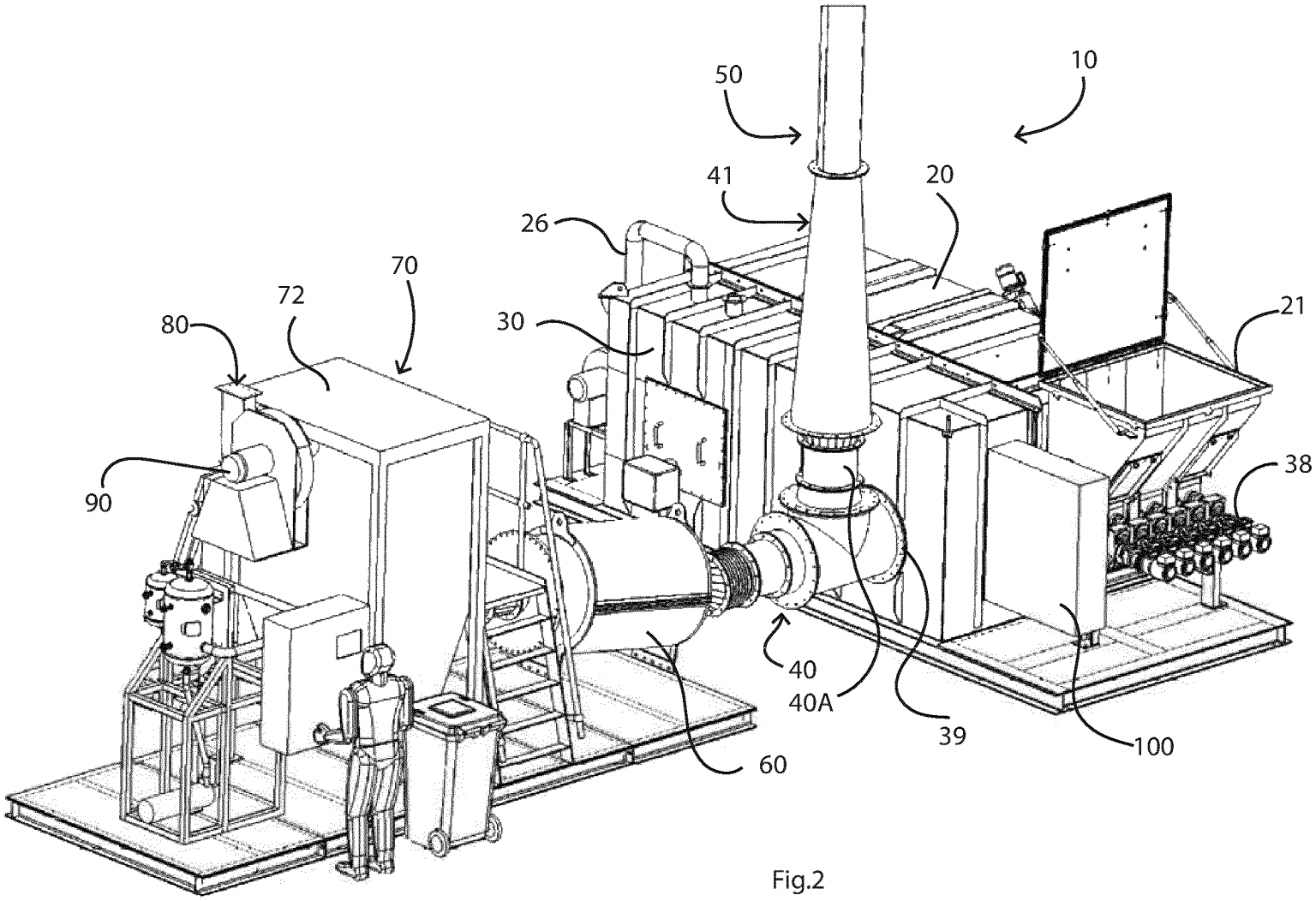
Figure 3:
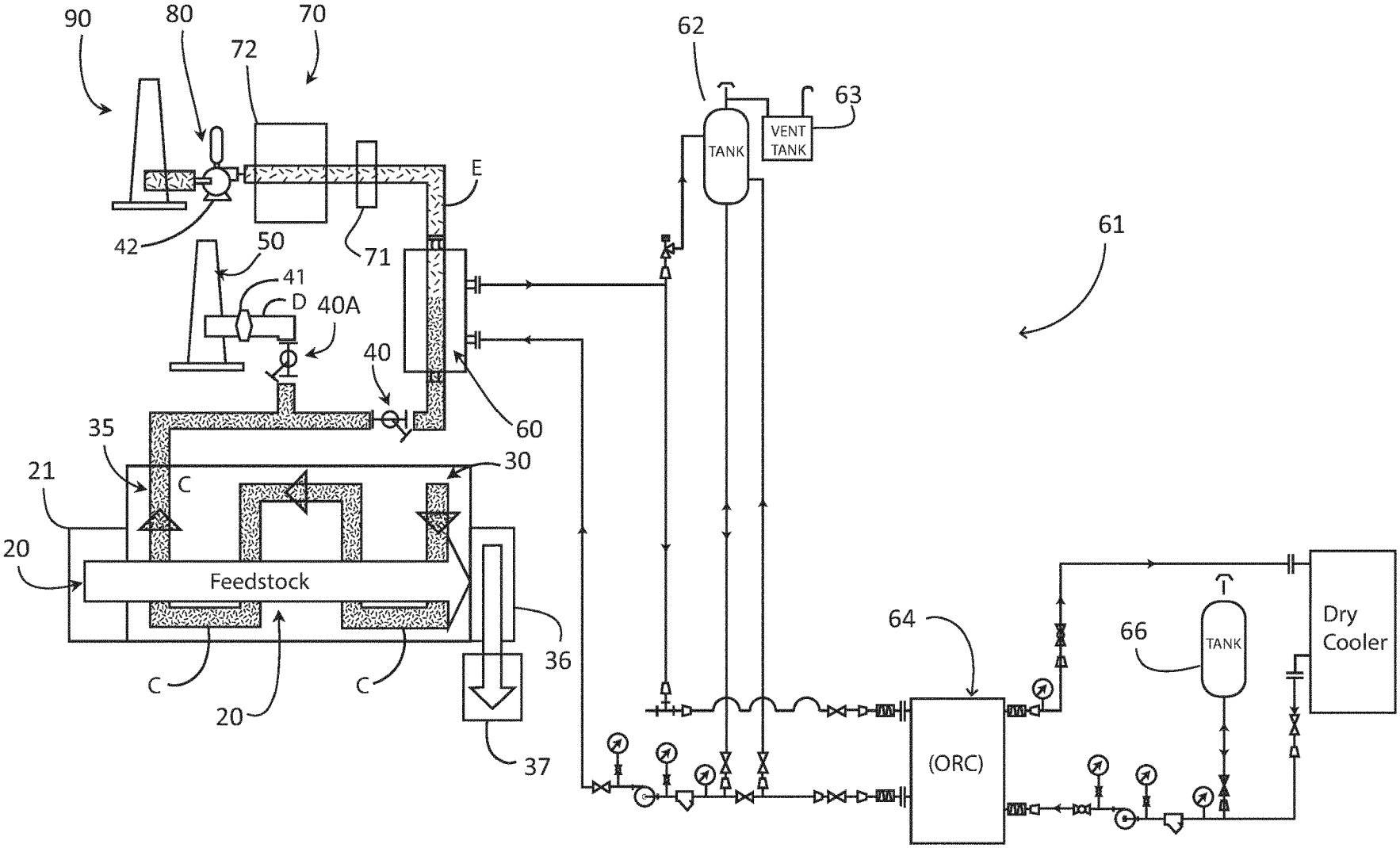
FIG. 3 is a flow diagram illustrating the major steps implemented by the system.

FIGS. 1 to 3 show a gasifier system including a gasifier 10 and downstream components as described below. The gasifier 10 comprises a generally rectangular unit housing a primary chamber 20, a mixing chamber 30 and a secondary chamber 35. As viewed in FIG. 1, a hopper 21 on the left feeds the feedstock into the primary chamber 20 in the upper portion extending to the right from the hopper 21. There are valved air inlets 27 in the side wall of the primary chamber 20. Augers 38, the motors of which are shown in FIGS. 1 and 2, are individually driven in the primary chamber 20 and at the end of the augers there is an ash removal chute 36 with a pumped ash outlet 37.

On the top right of the gasifier 10, as viewed in FIG. 1, there is a pumped air inlet 26 delivering air into the mixing chamber 30 to the far side of the primary chamber and running from right to left in this view. This feeds a secondary chamber 35 underneath the primary chamber 20 and there is a gasifier outlet, not visible in FIG. 1, leading to valves 40 and 40A.

Under normal operation, the valve 40 is open to allow flow of hot exhaust gases to a heat exchanger 60. In the event of a fault the valve 40 closes and the valve 40A opens to route the gases upwardly into a flue 50 incorporating a barometric damper 41, as best shown in FIG. 3.

The barometric damper 41 is not included in the process under normal operating conditions. The gas flow through the process is entirely regulated by an induced draft extraction fan 80 which is installed downstream of a filter stage 70. The barometric damper 41 cools the exhaust gases in a safety by-pass manner before discharge to atmosphere in the event that the heat exchanger and filter are not being used.

As shown specifically in FIG. 3, the heat exchanger 60 is in a heat exchange system 61 including also:

a head tank 62, a vent tank 63, an Organic Rankine Cycle Engine ORC 64, a dry cooler 65, and an expansion tank 66.

Advantageous aspects of the heat exchange system 61 are its flexibility and versatility of energy output devices. It is possible to generate electricity, provide steam or hot water, provide chilling and refrigeration and combinations of these to meet the user's requirements.

Downstream of the heat exchanger 60 the filter stage 70 has a reagent dosing station 71 followed by a ceramic filter 72. Downstream of the filter stage 70 there is the induced draft fan 80 which sucks gas through the whole plant in a dynamic manner according to sensors, as described in more detail below.

The fan 80 delivers cooled and clean draft out a flue 90.

Upstream of the primary chamber 20 the feed-hopper 21 delivers the organic feedstock into the primary chamber 20 by means of a series of independently-driven augers 38. The loading hopper 21 is configured to provide an air lock function to eliminate uncontrolled air entering the primary chamber 20.

The primary chamber 20 has an open lid section for ease of access for servicing and maintenance. This is achieved by unbolting and mechanically lifting (forklift). However, it is envisaged that it may include hydraulic rams for opening and closing.

An access and inspection hatch is provided adjacent to the mixing chamber 30 at the inlet of the secondary chamber 35.

The primary chamber 20 augers 38 are for conveying the feedstock being gasified, at a required rate. The augers have individual auger motors, which enables better control of flow of waste materials in the primary chamber 20 and also have a reverse function for quick and non-disruptive clearance of blockages and jamming that can occur from time to time in normal operation. Removable bearings and mounts at the ash end (right hand side as viewed in FIG. 1) of the primary chamber 20 allow access to the augers for removal and replacement of the augers which can be facilitated without shutting down the process entirely, thus minimizing down time and shut-down/start-up cycles.

Referring also to FIGS. 4 to 6, the primary chamber 20 has an external length of 4.0 m and in general preferably in the range of 3.75 m to 5.0 m to ensure adequate retention time of the material within the gasification zone. The feedstock is gasified in the primary chamber 20 by heat conducted through the floor, or hearth, 24 (FIG. 5). At the end of the primary chamber 20, distal from the hopper 21, the synthetic gases are generated by the gasification flow (arrow A) through an opening 25 into the mixing chamber 30, where they mix with a controlled quantity of air supplied by the secondary fan 26 mounted vertically in the mixing chamber 30 in a typical proportion of 1 part synthetic gas to 9 to 12 parts air by weight. This fan 26 has a variable-speed motor and is used to control the temperature in the secondary chamber 35 about a set point.

The action of the downstream fan 80 causes the flow A to become a flow B of synthetic gases and air downwards along the vertical length of the mixing chamber 30 and then laterally into the secondary chamber 35 where it is directed through several 90° turns by means of baffles 29 (FIGS. 5 and 6, flow C) before discharge to the heat exchanger 60. It will be noted that the roof of the secondary chamber forms the bed, or hearth, 24 of the primary chamber. During their passage through the secondary chamber 35, the combusted gases transfer heat to the hearth 24 to further the gasification in the primary chamber 20.

Under normal operation, combustion occurs in the mixing chamber 30 between the oxygen (air) supplied by the secondary fan 26 and the gases coming off the gasifying material in the primary chamber 20. In addition, small quantities of air can be drawn into the primary chamber through three 75 mm diameter automatically-actuated air control (e.g. Belimo™) valves 27. These valves are positioned strategically along the side wall of the primary chamber 20 and are operated intermittently from the central control processor 100 in conjunction with the induced draft ("ID") fan 80 to control the temperature in the primary chamber 20 about a set point using signals from temperature probes in the primary chamber 20.

The mixed gases enter the mixing chamber 30 where they ignite and are conveyed vertically downwards (Flow B). The mixing chamber may also be referred to as "the cracking zone", where further oxidation occurs in a turbulent combustion phase. This turbulence is continued into the secondary chamber (Flow C) or afterburner chamber 35 where the gases are made to abruptly change direction several times before exiting the secondary chamber.

The hearth 24 comprises high temperature resistant modular precast concrete units that interlock and are scalloped to accommodate the augers 38 used to propel the feedstock through the primary chamber. The heat generated by combustion of synthetic gases in the secondary chamber is conducted through the hearth 24 and generates the heat in the primary chamber 20 that sustains the autothermic gasification reaction and destruction of the feedstock. The manner in which the feedstock is conveyed by the augers 38 exposes the feedstock to heat that is absorbed and conducted through the hearth 24.

There is a flow of high temperature exhaust gases C which are the products of combustion of the synthetic gases controlled by the induced draft (ID) fan 80 (located downstream of the ceramic filter stage 70) which draws the exhaust gases out into the valve 40 from the secondary chamber 35.

The primary, mixing and secondary chambers 20, 30 and 35 respectively have pressure sensors linked with the controller 100. The fan 80 is controlled according to pressure differences across these chambers, which are designed to regulate the velocities of the exhaust gases throughout the process within the range of 0.6 to 1.2 m/s. This flow rate is designed to at least achieve the retention of exhaust gases within the gasifier for significantly longer than the regulatory (EU) stipulation of greater than 2.0 seconds at 850° C.

Typically, in the primary chamber 20 the temperature provided by the bed or hearth 24 is greater than 850° C. and there is typically a dwell time of the feedstock in the range of 30 to 90 minutes in the primary chamber 20 depending on the auger speed and resultant feed rate. Waste feedstock of high calorific value will require slower feed rates and vice versa.

The control of flow of the mixed gas (Flow C) through the secondary chamber 35 and out to the valve 40 is achieved by modulating the ID fan 80. The temperature in the secondary chamber 35 is controlled by modulating the air coming from the secondary fan 26. Under normal operation, the temperature in the secondary chamber is maintained at about 950° C. If the temperature in the secondary chamber begins to increase, the secondary fan 26 increases the supply of air until the temperature drops back to at or near the control temperature of 950° C. In this way, steady-state operation is maintained.

The primary chamber 20 relies solely on the gasification reaction to break down and destroy the organic material received at the intake hopper 21. There are no points of ingress of uncontrolled unregulated air, leaving only the controlled automated modulating valves 27 which are actuated to control the pressure difference between the primary chamber 20 and the secondary chamber 35.

The controller (programmable logic controller, PLC) 100 controls the valves according to pressure differentials so that the primary chamber valves 27 allow sufficient air into the zones of the primary chamber to maintain a pressure difference that maintains the target exhaust gas flow rates and velocities. The pressure differential sensor levels respond according to the throughput of the feedstock and the calorific value of that feedstock.

The synthetic gases are extracted from the primary chamber 20 by means of the modulating induced draft (ID) fan 80 located at the downstream point of the whole process (after the heat recovery 60/61 and filter 70 stages). The ID fan 80 is therefore integral to the control of flow of all the gases generated in the process.

The valve 40 has a default position of venting to atmosphere via the valve 40A and the flue 50 so that the hot gases exit safely in the event of a fault in the pneumatic air supply or electrical components, or other components of the system. The main control valve 40 and the diverter valve 40A are pneumatically activated. In the event of power failure, an accumulator will provide sufficient pressure to position the valves in the default position until power is restored.

The ash collection system 36 eliminates potential ingress of uncontrolled air via the exit end of the primary chamber 20. This is by way of a series of baffles that become sealed by the flow of exiting ash and the enclosed sealed ash removal system.

The products of combustion of the synthetic gas (exhaust gases) are drawn by the ID fan 80 through the secondary chamber 35 via the series of 90° bends formed by baffle walls 29 within the chamber, as shown in FIGS. 5 and 6. The abrupt changes of direction of flow created by the baffle walls 29 generate turbulent flows that offer better combustion and heat transfer via the hearth 24.

The hearth 24 heat sustains the autothermic gasification reaction in the primary chamber 20 and the distance travelled and velocity of the exhaust gases are controlled to retain the exhaust in the secondary chamber 35 for at least 3 seconds, i.e. longer than the standards stipulated in most international emissions quality standards for thermal oxidation of harmful pollutant substances. This achieves an excellent quality of combustion. The ID fan 80 is the principal means of regulating the quality of combustion, using inputs from sensors of the temperatures and pressures throughout the process. The controller 100 determines the required fan speed to optimise both the quality of combustion and the thermal energy recovered.

On start-up of the process, an auxiliary burner and fan 28, located at the bottom of the mixing chamber 30, is switched on using an external energy source. The mixing chamber 30 is in fluid communication with the primary chamber 20 via the aperture 25 in the dividing wall (Flow A). This aperture is 1.5 metres wide and is situated at least 250 mm above the top level of the augers 38 in the primary chamber 20. The mixing chamber 30 is in fluid communication with the mixing zone (Flow B) followed by the secondary chamber 35 (Flow C, FIG. 5).

The heat generated by the auxiliary burner slowly heats the secondary chamber 35. The roof of the secondary chamber 24 constitutes the floor of the primary chamber and is made of heat-conductive materials. Heat from the secondary chamber 35 is conducted through this floor, or hearth, to heat the primary chamber. When the temperature in the primary chamber exceeds 500° C., material to be gasified is drawn into the primary chamber 20 by means of a series of augers 38 which connect the feed-hopper 21 with the primary chamber 20.

As the temperature increases in the primary chamber 20, the material begins to gasify and the synthetic gases are carried through the aperture 25 to combust in the flame from the auxiliary burner 28 in the mixing chamber 30. This causes the temperature in the secondary chamber 35 to increase further. As the temperatures in both the primary and secondary chambers begin to reach target levels, the auxiliary burner 28 is switched off and the process becomes fully autothermic.

During the start-up cycle, the valve 40 is closed and the diverter valve 40A at the base of the stack maintains temperature in the secondary chamber 35. The operation of this valve is modulated between 0 and 100% opening by the controller 100. On completion of the start-up phase, the valve 40A is closed and will only open on emergency to divert the hot gases to the stack 50.

Flows of air and gases through the system are primarily controlled by the induced draft fan 80 downstream which maintains constant negative pressure throughout the system. The air valves 27 along the side-wall of the primary chamber 20 allow the ingress of oxygen (air) into the primary chamber 20 so that minor adjustment of temperatures and pressure can be achieved. The operation of these valves and the ID fan 80 are automatically controlled from the central controller 100 via pressure sensors and temperature probes deployed in the primary and secondary chambers.

The gasification and exhaust extraction process only reduces the exhaust gases to about 800° C. at the point of egress from the secondary chamber 35. This excess heat is then recovered via the heat recovery unit 60/61. On exit from the heat exchanger 60, the exhaust gases are between 160° C. and 200° C. and therefore can be finally treated and filtered by the filter 70 for removal of any remaining particulates and substances to ensure total compliance with the prevailing emissions standards at the location of installation.

The reagent dosing 71 involves adding controlled quantities of treatment substances such as (but not limited to) urea, calcium carbonate, sodium bicarbonate and activated carbon. These substances neutralise or remove harmful substances in the exhaust gases that are regulated by law such as (but not limited to) NOX, SOX, HCL, Dioxins, Phthalates, heavy metals.

The exhaust gases are processed initially by the heat pipe heat exchanger 60 to cool the outlet temperature from a range of 740° C. to 800° C. to 160° C. to 180° C.

The output from the heat exchanger 60 provides the thermal energy in a variety of formats to suit the end user's requirements, such as hot water, steam, and thermal oil. This gives the end user the ability to utilize the thermal energy for a variety of applications:

Heating
Cooling/refrigeration
Process steam
ORC (Organic Rankine Cycle) power generation
Micro steam turbine/engine power generation.

On exiting the heat pipe heat exchanger 60, the remaining exhaust gases are further processed by the ceramic filter unit 70 with reagent dosing system 71. The ceramic filter 72 removes the fine particulate content to comply with the regulatory standards of less than 10 $mg/Nm^3$ while the reagent dosing introduces a prescribed blend of additives to remove any remaining toxic constituents in the exhaust gas in compliance with the regulatory industrial emissions standards.

The apparatus may include a CO2/NO2 fire suppression system. Fires are extremely unlikely due to the absence of air, but in the event of an uncontrolled ingress of oxygen leading to combustion in the primary chamber, the PLC system will identify this and initiate an automated rapid shut down procedure where a compressed inert gas suppression system will extinguish and rapidly cool the primary chamber. Using water to extinguish a fire would be dangerous for the operator and potentially catastrophic for the equipment.

It will be appreciated that the invention provides an integrated waste-to-energy system based on the gasification of various organic waste streams having an inherent energy content (calorific value) that can be exploited to produce useable energy in various forms such as hot water, steam and/or electricity by the use of an Organic Rankine Cycle (ORC) engine downstream of the heat-exchanger.

The system offers a very advantageous method of waste treatment and disposal for many small to medium-sized industries with troublesome waste streams. In particular it offers a safe and environmentally friendly way of dealing with agricultural waste such as poultry manure/litter and many other animal by-products (ABP). It also has applications in the medical waste sector where the cost of treatment has escalated to alarming proportions in recent years.

The filter stage 70 can be designed to cope with emissions from both hazardous and non-hazardous waste streams and to provide for compliance with the most stringent European Industrial Emissions Standards. The ash residue which exits the end of the primary chamber is completely mineralised and may be used beneficially in many applications.

Control Scheme

The controller 100 receives inputs from the following sensors:

Temperature sensors in each of the primary, mixing, and secondary chambers and subsequently before and after both the heat exchanger 60 and the ceramic filter 72.

Pressure sensors in each of the chambers 20, 30, and 35.

The controller 100 controls the following to control operation of the gasifier to optimum conditions:

The mixing chamber 30 air inlet fan 26.

The valves 27 regulating flow of air over the augers in the primary chamber

The valve 40 for flow of air downstream from the secondary chamber towards the heat exchanger 60.

The induced draft fan 80.

The PLC controller 100 is programmed to respond to changes in parameters within the system to maintain optimum temperatures required to sustain the gasification reaction and both the quantity of thermal energy consumed within the process and generated for heat recovery at the heat exchanger.

A reduction in temperature in the secondary chamber 35 may signify a reduction in calorific value of the organic material in the primary chamber. The PLC identifies this from the temperature sensors in the primary chamber 20 and increases the speed of the augers 38 to maintain a constant calorific content in the primary chamber 20. This may also then result in changes in pressure and temperature in the primary and secondary chambers which the PLC 100 will identify from the pressure sensors and temperature sensors in both chambers. In response the PLC can modulate the ID fan 80, the secondary fan and the primary chamber air valves 27 to balance the system and maintain optimum performance.

Energy recovered from the input material starts by being introduced from the hopper 21 into the (preheated) primary chamber 20 by the series of rotating screws 38. The preheating is done by the fossil fuel burner 28. As the material travels along this negative pressure chamber and having the correct temperature, syngas is released which then travels to the secondary chamber 35 for final combustion assisted by the secondary air injection point 26. The remaining material now in the form of ash is extracted by means of the rotating auger 36 to a final ash storage bin 37. The heated gas then is pulled to the heat exchanger 60 by means of the induced draft fan 80 where the energy is transferred for power and heat production. The remaining gas is then cleaned by the filter 70.

This controller 100 is responsible for safety, temperature, material level control, energy output control, ash removal, chamber pressure control, gas cleaning, start-up, shut-down procedures, data logging, fault diagnosis, alerts messaging and remote monitoring.

Table 1 describes function of some of the apparatus' components in more detail.

TABLE 1

| Controlled Component | Function |
|---|---|
| Auger motors (38) | Propel the rotation of the feed augers and reverse to clear blockages as required |
| Air Valves (27) | Control pressure differential between primary and secondary chamber. Control of temperature in primary chamber to aid in production of synthetic gases |
| Ash End Motor/Auger (37) | Ash removal |
| Secondary Fan (26) | Introduction of clean air for combustion of synthetic gases |
| Burner (28) | Starting of gasifier and maintaining the secondary chamber above 850 degree C. during operation |
| Flu gas by-pass stack damper valve (40A) | Control of release of exhaust during preheat and safety release of hot exhaust gases in the event of downstream component failure |
| Heat exchanger flu gas inlet damper valve (40) | Isolation of heat exchanger, filter and downstream equipment |
| Air Compressor | Control of flu gas damper valves. Cleaning of filter housing. |
| System ID Fan (80) | Induced draft of all gases in the system |
| Auxiliary Systems (61-69) | Electrical Power/refrigeration as required |
| Shredding/Loading/ feed system (21) | Provide material as dictated by hopper level indicators |

Table 2 is an example controller 100 logic flow.

TABLE 2

| Example PLC logic sequence | | |
|---|---|---|
| Function: | Safety | Protection of Heat Exchanger Device |
| Inputs | T5 (HE 60 inlet gas temp.), T6 (HE outlet gas temp.) | |
| Action | T5 >/= 875° C. | Modulate fans 26 and 80<br>Manage exhaust gas temperatures within nominal operating range by addition of dilution air |
| Alarm | T5 >/= 900° C. | Audio/visual alarm. Alert operator via remote telemetry |
| Action | T5 >/= 900° C. | Modulate fans (26, 80)<br>Manage exhaust gas temperatures within nominal operating range |
| Action | T5 >/= 925° C. | Actuate diverter damper valves (40, 40A)<br>Exhaust gases diverted to atmosphere to protect heat exchanger and filter devices |

Table 3 below gives preferred temperature ranges maintained by the controller 100 for operation of various components.

TABLE 3

| Temp. Sensor Location | Temperature Range (° C.) |
|---|---|
| Inlet hopper (ambient) | 0-40 |
| Primary Chamber Inlet | 20-600 |
| Primary Chamber Gasification Zone | 500-1000 |
| Primary Chamber Ash Zone | 550-1200 |
| Secondary Chamber | 700-1200 |
| Heat Exchanger Exhaust Gas Inlet | 600-850 |
| Heat Exchanger Exhaust Gas Outlet | 160-220 |
| Heat Exchanger Cold Side Inlet | 160-220 |
| Heat Exchanger Cold Side Outlet | 140-200 |
| Filter Inlet | 160-220 |
| Filter Outlet (stack) | 140-200 |

In another embodiment, and referring to FIG. 7, between 25% and 40% w/w of the exhaust gases which exit the heat exchanger 60 (in the range of 160° C. to 200° C.) will be recirculated back into the secondary chamber 35 at the mixing chamber to reduce the oxygen content in the process in order to reduce the content of oxides of nitrogen thus further improving the emissions performance of the system. FIG. 7 shows a feedback circuit 110 with a feedback conduit 111 and a high temperature recirculating fan 112 linked to the controller, to achieve this. This reduces the $O_2$ content in the secondary chamber, which assists in the reduction of production of oxides of nitrogen (NO). The speed of the recirculation fan 112 can be set and fixed independently of the PLC controller by the operator or can be controlled via the controller depending on the nature of the material being processed The invention is not limited to the embodiments described but may be varied in construction and detail according to the claims. For example, the system may be provided in a mobile containerised format. This type of configuration facilitates the rapid transportation of the system to the site of an emergency or to a remote location where it might help to solve a temporary waste problem in a military or industrial context.

The invention claimed is:

1. A gasification apparatus comprising:

a primary chamber with a floor comprising a hearth and feedstock augers, for gasification of feedstock, the primary chamber comprising at least one air inlet valve for inlet of air over the hearth;

a loading hopper configured to feed feedstock into the primary chamber;

an ash collection system;

a mixing chamber configured to receive, through an opening, synthetic gases from the primary chamber, and comprising an air inlet fan for adding oxygen for ignition;

a secondary chamber linked with the mixing chamber, configured to deliver heat from combustion of gases from the mixing chamber to the hearth, said hearth forming a roof of the secondary chamber;

an outlet valve configured to deliver of gases from the secondary chamber;

a fan downstream of the secondary chamber; and a controller, wherein the secondary chamber includes baffles for flow under the hearth, the controller is programmed to dynamically control flow of gases in the chambers according to sensed pressures and temperatures in said chambers, said controlled flow including flow through the secondary chamber around said baffles to optimize combustion in an after-burner phase, and said control including controlling flow rate caused by the downstream fan, the controller is programmed to control the at least one primary chamber air inlet valve according to pressure created in the mixing chamber by a mixing chamber air inlet fan, the controller is programmed to cause air flows through the primary chamber air inlet valves to maintain both desired synthetic gas to air ratio and a desired pressure differential between the primary chamber and the mixing chamber for maintaining a negative pressure oxygen deprived environment within the primary chamber, in which the controller is programmed to maintain a pressure in the range of −50 Pa to −200 Pa (−5 mm to −20 mm $H_2O$) in said oxygen deprived environment, the ash collection system is configured to eliminate potential ingress of uncontrolled air via an exit end of the primary chamber, the loading hopper is configured to provide an air lock function to eliminate uncontrolled air entering the primary chamber, and said opening between the primary chamber and the mixing chamber comprises an aperture in a dividing wall between said chambers, and said aperture being situated at least 250 mm above a top level of the augers in the primary chamber.

2. The gasification apparatus as claimed in claim 1, wherein the controller is configured to cause said afterburner phase for passage through the secondary chamber to have a duration of at least 3 seconds.

3. The gasification apparatus as claimed in claim 2, wherein the fan is an induced draft fan.

4. The gasification apparatus as claimed in claim 1, wherein the outlet valve is arranged to direct gases downstream under normal process conditions or to a safety vent through a diverter valve; and wherein the safety vent comprises a flue with a barometric damper.

5. The gasification apparatus as claimed in claim 1, comprising a heat exchanger downstream of the secondary chamber, said heat exchanger being linked to a heat recovery system; and further comprising a filter downstream of the heat exchanger.

6. The gasification apparatus as claimed in claim 1, wherein the filter comprises a reagent dosing apparatus followed by a ceramic filter apparatus; and the reagent dosing apparatus is configured to add controlled quantities of treatment substances suitable to neutralise or remove potentially harmful substances in the exhaust gases.

7. The gasification apparatus as claimed in claim 1, wherein the controller is configured to control the mixing chamber air inlet fan to maintain temperature in the secondary chamber in the range of 850° C. and 1050° C.; and wherein the controller is configured such that if the temperature in the secondary chamber begins to increase above a target, the mixing chamber air inlet pump increases the supply of air until the temperature drops back to at or near a target temperature for steady-state operation.

8. The gasification apparatus as claimed in claim 1, wherein the mixing chamber includes a burner for process start-up and the controller is configured to shut down the burner when an autothermic stage is reached with a target temperature for the primary chamber; and wherein the burner is located in a lower portion of the mixing chamber.

9. The gasification apparatus as claimed in claim 1, wherein the controller is configured to control said secondary chamber outlet valve to assist with control of temperature in the secondary chamber during start-up; and wherein the controller is configured to modulate said valve between 0% and 100% opening by the controller.

10. The gasification apparatus as claimed in claim 1, wherein the controller is configured to cause flow of gases from the secondary chamber at a temperature in the range of 700° C. and 900° C., and to control the heat exchanger to reduce the temperature of the gases to a value in the range of 160° C. to 200° C.; and further comprising temperature sensors at an inlet of the heat exchanger and at an outlet of the heat exchanger, and the controller is configured to modulate the downstream fan and the mixing chamber air inlet fan to maintain exhaust gas temperatures from the secondary chamber within a desired range; and wherein the controller is configured to actuate a diverter damper valve to divert exhaust gases to atmosphere if temperature at the heat exchanger inlet exceeds a threshold.

11. The gasification apparatus as claimed in claim 1, wherein the controller is configured to maintain the temperature of the primary chamber in the range of 500° C. to 1000° C., and of the secondary chamber in the range of 550° C. to 1200° C.; and wherein the controller is configured to maintain the temperature of a heat exchanger inlet in the range of 600° C. to 850° C. and of a heat exchanger outlet in the range of 160° C. and 220° C.

12. The gasification apparatus as claimed in claim 1, further comprising a feedback circuit to feed back a portion of exhaust gases which exit the heat exchanger to the secondary chamber; and wherein the controller is configured to feed back a portion in the range of 25% to 40% of said gases from the heat exchanger.

13. The gasification apparatus as claimed in claim 12, wherein the controller is configured to perform said feedback when the temperature of gases exiting the heat exchanger is in the range of 160° C. and 200° C.

* * * * *